United States Patent [19]

McKee, Jr.

[11] 3,998,326

[45] Dec. 21, 1976

[54] PACKAGING FORMING PACKAGES OF STRAND MATERIAL

[75] Inventor: Roger H. McKee, Jr., Shelby, N.C.

[73] Assignee: PPG Industries, Inc., Pittsburgh, Pa.

[22] Filed: Jan. 29, 1976

[21] Appl. No.: 653,321

[52] U.S. Cl. ..... 206/407; 206/389

[51] Int. Cl.[2] ..... B65D 85/67; B65D 85/04

[58] Field of Search ..... 206/407, 389, 397; 242/170, 171

[56] References Cited

UNITED STATES PATENTS

| | | | |
|---|---|---|---|
| 3,731,792 | 5/1973 | Rolston | 206/389 |
| 3,796,305 | 3/1974 | Beason | 206/407 |

*Primary Examiner*—George T. Hall

*Attorney, Agent, or Firm*—Alan T. McDonald

[57] ABSTRACT

A container for transporting and protecting forming packages of fiber strands, and especially glass fiber strands, is disclosed. The container comprises a tray to which the forming package is attached, a pair of end caps for protecting the fragile edges of the forming package of strand having means thereon for frictionally engaging a covering tube, and a covering tube frictionally engaging the pair of end caps and covering the end caps, the tray, and the forming package of strand. The composite container protects the strand from damage during transit and especially from damage to the edges of the forming package due to bumping. The composite container allows unwinding of the strand without the necessity of removing the forming package of strand from the container.

9 Claims, 2 Drawing Figures

PACKAGING FORMING PACKAGES OF STRAND MATERIAL

BACKGROUND OF THE INVENTION

Fiber strands are typically wound into generally cylindrical forming packages by means of a winder. In the case of glass fiber strand, glass filaments are attenuated through bushing tips in a bushing, coated with an aqueous binder and/or size, gathered into a composite strand in a gathering shoe, and wound around the mandrel of a winder with or without a forming tube covering the mandrel. In the case of glass strand, the winder provides the attenuation forces necessary to form the glass filaments as well as serving to collect the resulting strand.

After winding, the resulting forming package is dried and the forming tube on which the package was wound, if such a tube was employed, may be removed. The dried package is now ready for shipment to customers.

In the past, a plurality of forming packages were laid on their sides in individual compartments in a corrugated cardboard container. A plurality of layers of these packages comprised a single shipping package. The problems with such packages include the fact that forming packages have been increased in size and weight to a level which makes it difficult if not impossible to manually pack the large packages into the prior art containers. For example, typical small forming packages weigh approximately 20 to 30 pounds (9.1 to 13.6 kilograms). However, in addition to the smaller packages, forming packages weighing as much as 110 pounds (49.9 kilograms) and even more are now being employed. Such packages are difficult to handle and difficult to pack.

A second and even more important problem with the prior art methods of packaging forming packages is the damage which may result to the forming package during transit. In transit, the loosely packed forming packages are often able to move within their compartments. This allows the edges of the forming package to come in contact with the partitions of the shipping container. Such bumping of the forming package edges against the container damages the fragile edges making unwinding of the strand difficult and often causing damage to the continous strand at the edges.

In U.S. Pat. No. 3,731,792, it is suggested to glue a wrapper around the glass strand package and cover the edges of the package with end caps. This requires, however, that an adhesive be placed on the outermost glass strands. Further, these containers are round and thus will not permit a plurality of containers to be stacked on their sides.

In U.S. Pat. No. 3,796,305 a fiber glass forming package container is disclosed including a covering tube and a pair of end caps, the forming package being frictionally nestled in the end caps. A problem with this package is that the fragile edges of strand are exposed, even though recessed from the outer ends of the container, and damage can still result to the forming package.

It is desirable, therefore, to produce a shipping container for forming packages of strands, and especially glass strands, which handles large forming packages in a simple manner, which may be easily stacked, which prevents damage to the edges of the forming package and which eliminates the necessity of placing an adhesive on the glass strand.

THE PRESENT INVENTION

The present invention involves a container for forming packages of strand material, and especially glass strands, which accomplishes these results. The container comprises a tray to which the forming package is attached by one or more bands, a pair of end caps to protect the edges of the strand and to provide support for stacks of containers which do not come into contact with the edges of the forming package, said end caps having means for frictionally engaging a covering tube, and a covering tube which covers the end caps, the tray, and the forming package to form a composite container for the forming package. The container allows strand to be removed from the forming package without the necessity of removing the forming package from the container. This latter innovation decreases unnecessary handling and possible damage to the strand of the forming package.

DETAILED DESCRIPTION OF THE PREFERRED EMBODIMENT

Figure 1:
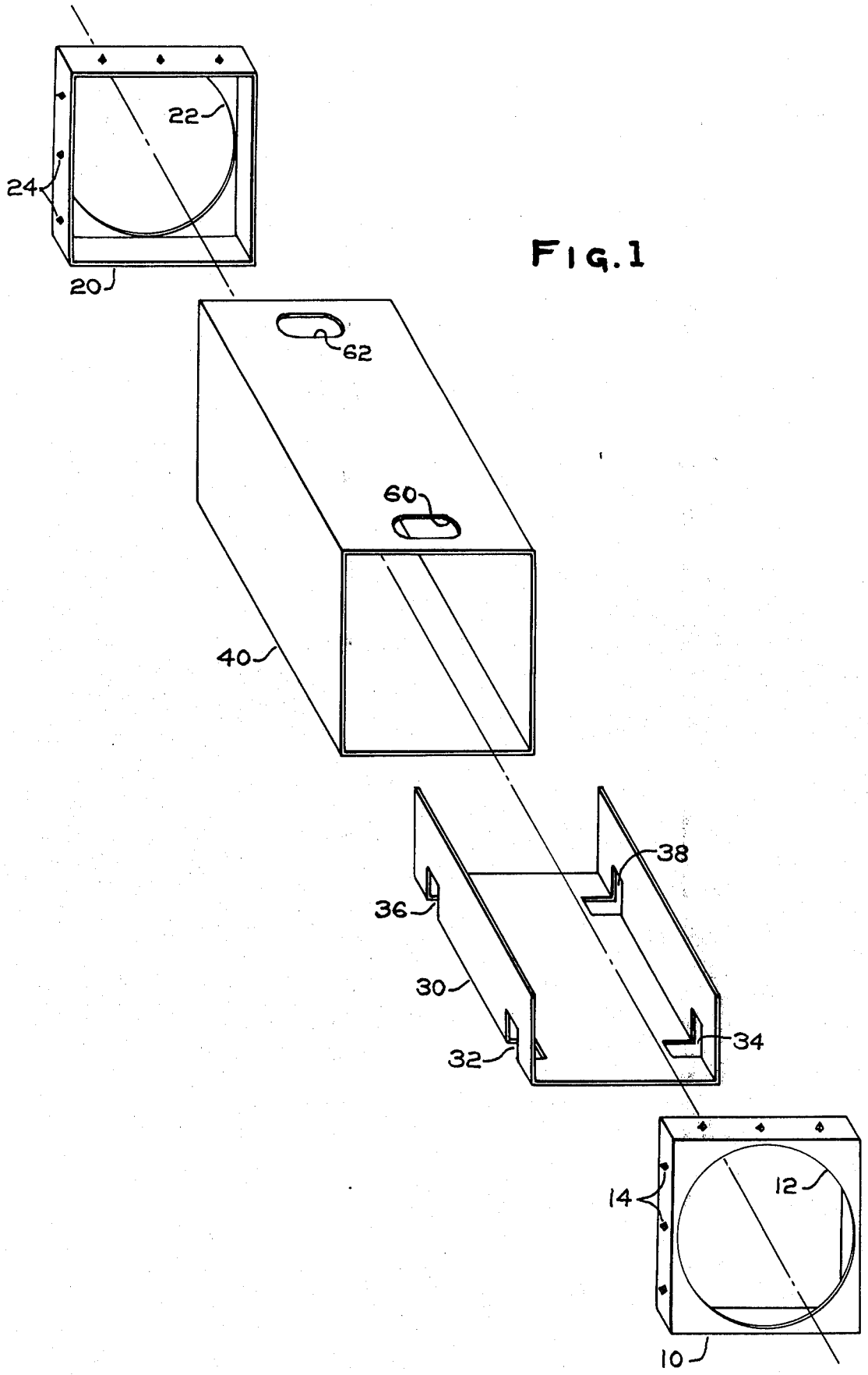
FIG. 1 is an isometric representation of the elements of the composite container of the present invention and their relationship to each other.
Figure 2:
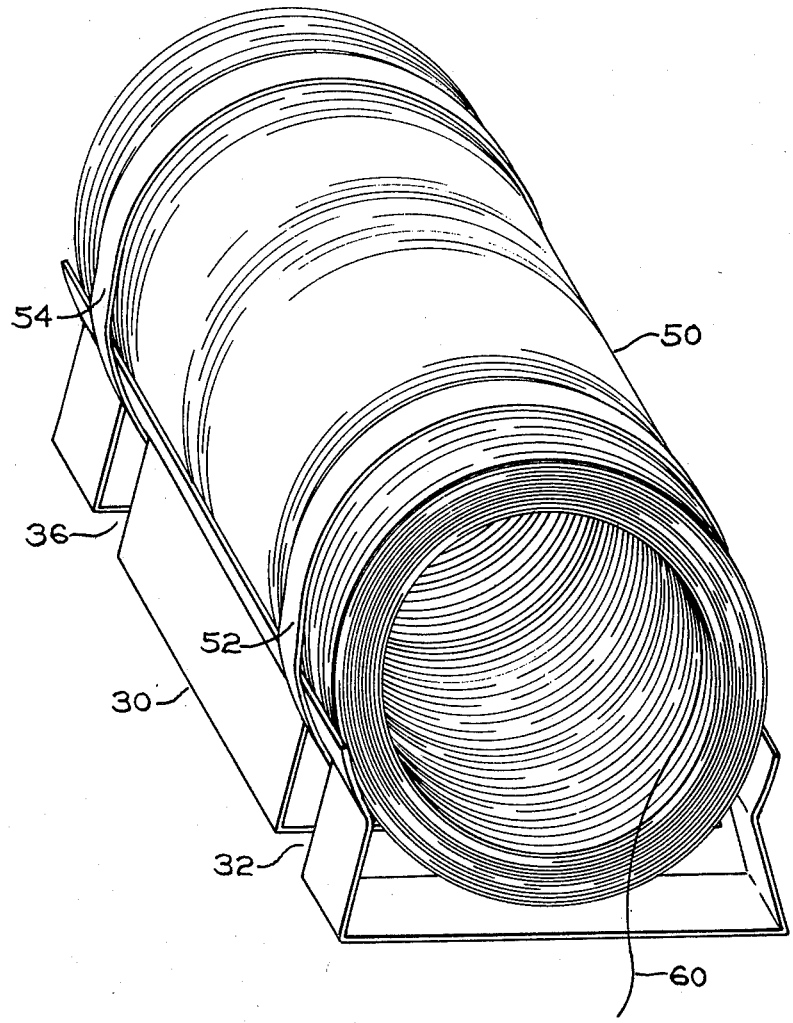
FIG. 2 represents the location of the forming package within the tray.

Referring now to the Figures, a tray 30 having apertures 32, 34, 36 and 38 is illustrated. The tray 30 is formed of a length slightly longer than the length of the forming package to be placed in the container. For example, for 26.0 inch (66.04 centimeter) long forming packages, the tray 30 is formed 27.50 inch (69.85 centimeter) long. The tray may be formed, for example, of corrugated cardboard, which permits the tray to be die cut and folded into its final shape. Of course, the tray may be formed of other materials, such as molded polystyrene, polyethylene, or any other material having the requisite strength. As shown in FIG. 2, a forming package 50 is laid into the tray 30 and one or more bands 52 and 54, such as tape, are placed around the forming package 50 and the tray 30, such that the band or bands 52 and 54 are located within opposing pairs of apertures 32 and 34 or 36 and 38. The tray 30 is then slid into the covering tube 40 and fastened in place, such as by stapling, such that the covering tube 40 extends at an equal distance on both ends from the tray. A pair of end caps 10 and 20 are then positioned at each end of the covering tube. These caps 10 and 20 cover and protect the fragile edges of the forming package 50 from damage during transit. The end caps 10 and 20 have apertures 12 and 22, respectively, therein. These apertures are approximately the same diameter as the inner diameter of the forming package 50. They permit strand to be unwound from the inside of the forming package 50 without the necessity of removing the forming package 50 from the composite container. This reduced unnecessary handling of the fragile forming package 50 and further decreases the chances of damage to the strand contained thereon. The end caps 10 and 20 further have a plurality of protrusions or teeth 14 and 24, respectively, which frictionally engage the end caps 10 and 20 with the inside of covering tube 40. The end caps 10 and 20 are formed of a material which besides protecting the edges of the forming package has the requisite strength for supporting a plurality of the composite packages when they are stacked upon each other. Molded plastic resins have been found to be suitable materials for these end caps 10 and 20 both in terms of strength and in ease of fabrication. Such materials include high impact polystyrene, polyethylene, polyvinyl chloride and the like. While these materials are preferred for their ease of formation into the desired shape, other materials, such as wood, metal, and the like could be used.

The cover tube 40 is formed having a length equal to the length of the tray 30 with the end caps 10 and 20 in place. Thus, when the composite container is assembled, the end caps 10 and 20 are approximately flush with the ends of the cover tube 40. The cover tube 40 is formed, for example, of corrugated cardboard and its ends are identical in size and shape with the end caps 10 and 20. The protrusions or teeth 14 and 24 on the end caps 10 and 20, respectively, frictionally hold the end cpas 10 and 20 firmly in place within the tube 40. This forms a composite container which protects the forming package 50 and is yet easy to assemble and has a high degree of strength compared to its weight. Due to the frictional fastening of the end caps 10 and 20 to the cover tube 40 alone it is simple, if desired, to remove either or both end caps for unwinding the forming package, if desired, however, the structure of the composite container makes such removal unnecessary in most circumstances. The cover tube 40 may additionally include one or more handle openings 60 and 62 die cut therein to facilitate handling of the composite container.

EXAMPLE

Thirty forming packages having an inner diameter of approximately 12 inch (30.48 centimeter) and a length of approximately 26.0 inch (66.04 centimeter) were packaged in containers as illustrated in the Figures. The trays 30 employed were formed of die cut corrugated cardboard and the forming packages 50 were connected to the trays 30 using two lengths of 2 inch (5.08 centimeter) wide polyethylene tape 52 and 54. The end caps 10 and 20 were molded of high impact polystyrene and had openings 12 and 22 having diameters of 12.0 inch (30.48 centimeter) and a plurality of teeth 14 and 24, respectively, molded on their edges. The covering tube 40 had square ends having an inside dimension of 14.5625 inch (36.98875 centimeter) on a side, the same as the outside dimensions of the end caps, and a length of 28.5 inch (72.39 centimeter). The composite packages were transported on a pallet having two rows of three containers laid side to side in each row, five layers high. The 30 forming packages were successfully transparted without damage.

As can be seen from the above Example, the container of the present invention provides an apparatus for transporting large forming packages of strand material without damage to the fragile strands.

While the invention has been disclosed with reference to a specific embodiment thereof, it is not intended to be so limited thereby except insofar as in the accompanying claims.

I claim:

1. A container for transporting a forming package of strand material comprising: a tray having a plurality of apertures therein for receiving said forming package, one or more bands surrounding said forming package and tray and being located within a pair of opposing apertures, a pair of end caps covering the ends of said forming package and having means for frictionally engaging a covering tube, and a covering tube frictionally engaging said end caps and covering said end caps, said tray, and said forming package.

2. The container of claim 1 wherein said end caps include an aperture for unwinding said strand from said forming package without removal of said forming package from said container.

3. The container of claim 2 wherein said end caps are formed of high impact polystyrene.

4. The container of claim 1 wherein said tray is formed of die cut corrugated cardboard.

5. The container of claim 1 wherein said covering tube is formed of corrugated cardboard.

6. The container of claim 1 wherein said bands are formed of polyethylene tape.

7. The container of claim 1 wherein said forming package is formed of glass strand.

8. The container of claim 1 wherein said means on said end caps for frictionally engaging said covering tube are a plurality of protrusions.

9. The container of claim 1 wherein said covering tube includes one or more handle openings.

* * * * *